US006564475B2

(12) United States Patent
Collins et al.

(10) Patent No.: US 6,564,475 B2
(45) Date of Patent: May 20, 2003

(54) FOOTWEAR WITH ENHANCED TEMPERATURE CONTROL

(75) Inventors: Jason H. Collins, Agoura Hills, CA (US); Susan M. Peterson, Oak Park, CA (US)

(73) Assignee: K-Swiss Inc., Westlake Village, CA (US)

( * ) Notice: Subject to any disclaimer, the term of this patent is extended or adjusted under 35 U.S.C. 154(b) by 0 days.

(21) Appl. No.: 09/741,793

(22) Filed: Dec. 22, 2000

(65) Prior Publication Data

US 2002/0078590 A1 Jun. 27, 2002

(51) Int. Cl.[7] ..... H43B 7/06

(52) U.S. Cl. ..... 36/3 R; 36/3 B; 36/3 A; 36/30 R

(58) Field of Search ..... 36/3 R, 3 B, 3 A, 36/30 R, 44

(56) References Cited

U.S. PATENT DOCUMENTS

| | | | | |
|---|---|---|---|---|
| 206,267 A | | 7/1878 | Schwarzwald | |
| 220,475 A | | 10/1879 | Hannaford | |
| 452,655 A | | 5/1891 | Valiant | |
| 1,264,122 A | * | 4/1918 | Paul | 36/3 B |
| 1,317,161 A | | 9/1919 | Hay | |
| 2,239,211 A | | 4/1941 | Wylie | |
| 3,624,930 A | | 12/1971 | Johnson et al. | |
| 4,055,699 A | | 10/1977 | Hsiung | |
| 4,183,156 A | | 1/1980 | Rudy | |
| 4,438,573 A | * | 3/1984 | McBarron | 36/3 B |
| 4,602,442 A | * | 7/1986 | Revill et al. | 36/43 |
| 4,689,899 A | | 9/1987 | Larson et al. | |
| 4,776,110 A | | 10/1988 | Shiang | |
| 4,813,160 A | | 3/1989 | Kuznetz | |
| 4,887,368 A | * | 12/1989 | Latzke | 36/44 |
| 4,888,887 A | | 12/1989 | Solow | |
| 5,086,572 A | * | 2/1992 | Lee | 36/3 R |
| 5,220,791 A | | 6/1993 | Bulzomi | |
| 5,584,130 A | * | 12/1996 | Perron | 36/44 |
| 5,675,914 A | * | 10/1997 | Cintron | 36/3 B |
| 5,782,014 A | | 7/1998 | Peterson | |
| 5,845,418 A | * | 12/1998 | Chi | 36/3 B |
| 5,926,977 A | * | 7/1999 | Sanders | 36/7.1 R |
| 6,004,662 A | | 12/1999 | Buckley | |
| 6,088,935 A | * | 7/2000 | Pavelescu et al. | |
| 6,092,305 A | * | 7/2000 | Troy et al. | 36/3 B |
| 6,209,228 B1 | * | 4/2001 | Yang | 36/44 |

FOREIGN PATENT DOCUMENTS

| | | | |
|---|---|---|---|
| EP | 350103 | * | 1/1990 |
| FR | 2670369 | * | 6/1992 |
| GB | 2137866 | * | 10/1984 |

* cited by examiner

*Primary Examiner*—M. D. Patterson
(74) *Attorney, Agent, or Firm*—Oblon, Spivak, McClelland, Maier & Neustadt, P.C.

(57) ABSTRACT

A shoe, particularly an athletic shoe, in which a multilayer assembly is disposed between the midsole and the insole of the shoe, with the multilayer assembly inhibiting the transfer of heat by virtue of a heat resistant layer or film disposed within the multilayer assembly. The multilayer assembly preferably includes a metalized Mylar (polyethylene terepthalate) film which is sandwiched between two layers of strobel material. This arrangement provides an effective and durable design which inhibits the transfer of heat from hot surfaces to the foot. In accordance with a further aspect, an advantageous ventilation system is provided in the insole, with the ventilation system particularly effective since it is shielded from heat utilizing the multilayer assembly.

33 Claims, 5 Drawing Sheets

FOOTWEAR WITH ENHANCED TEMPERATURE CONTROL

FIELD OF THE INVENTION

The invention relates to footwear, and particularly to athletic footwear having features which provide improved comfort to the wearer, particularly from a standpoint of modulating or controlling the temperature of the foot. The invention is primarily directed to a shoe having features to keep the foot cool and dry. Certain aspects of the invention could also be utilized in footwear designed to keep the foot warm.

BACKGROUND OF THE INVENTION

Discussion of Background

The footwear industry, particularly the athletic footwear industry, has seen numerous design features introduced in order to enhance the comfort and/or performance of the wearer. Often such modifications relate to enhancing the manner in which the shoe supports the foot, such that the shoe can, for example, better absorb impacts or allow the wearer to more comfortably exert a large amount of force while reducing the possibility of injury. These designs modifications demonstrate, that comfort and performance are often interdependent. An athlete who can rely upon his or her footwear to perform without injury or discomfort can better train and perform up to their potential.

One aspect of footwear design which often receives less attention relates to foot temperature and the ability of the footwear to prevent excessive heat or, in some instances, to retain heat. For many athletic activities, such as running or tennis, the wearer must perform in hot temperatures and upon surfaces (e.g., asphalt) which can be even hotter than the ambient temperature. In these conditions, it is important for the shoe to keep the foot as cool and dry as possible. Similarly, if the athlete is to perform in cold conditions, the footwear should be able to retain heat to optimize the wearer's performance and prevent injury.

Whether the athlete is an occasional athlete or a professional, the ability of the footwear to modulate temperature can have both comfort and performance effects. Obviously, whenever there is foot discomfort, the physical activity is less enjoyable. In addition, such discomfort can psychologically and physiologically detract from the performance of the wearer. Generally, with athletic footwear utilized, e.g., in running or tennis, it is desirable to prevent overheating of the foot. Excessive foot temperature can lead to excessive perspiration and premature fatigue (mentally and physically). Further, excessive perspiration can also detract from the wearer's ability to react quickly, take a quick step, or change directions, since the foot is held less firmly within the shoe.

Under certain conditions, it can also be desirable to retain heat, e.g., where the athletic activity is to be performed in a cold climate. The retention of heat can be important in providing comfort to the wearer, preventing injury or frostbite, and providing better circulation. Obviously, temperature modulation is very important in enhancing the wearer's comfort and performance.

A number of footwear designs have attempted to provide desirable temperature modulation. For example, U.S. Pat. No. 4,055,699 to Hsiung discloses the use of a four layer insole to enhance the insulating characteristics of the shoe, with the bottom layer formed of aluminized Mylar. However, the Hsiung arrangement is suitable for cold climates, but does not assist in modulating foot temperature in hot conditions. Moreover, the use of Mylar at the bottom of the insole can be problematic in that the Mylar can deteriorate or degrade with use. Further, if the Mylar is utilized in hot conditions as a bottom layer, there is an increased possibility of degradation and/or delamination of the Mylar.

Particularly from a standpoint of preventing excessive heating of the foot, the primary difficultly resides in the ability to modulate heat at the underside of the foot. However, it can be difficult to incorporate successful temperature modulating features without detracting from cushioning and support functions—which are often the primary focus of athletic shoe designs in the region beneath the foot. Thus, it can be difficult to provide a design which will not interfere with the cushioning/support functions of the shoe while also providing a durable design which can keep the foot cool and dry.

SUMMARY OF THE INVENTION

It is an object of the invention to provide a shoe having enhanced capabilities in controlling or modulating the temperature of the wearer's foot. Although the primary focus of the invention resides in the ability to prevent overheating of the foot, and to keep the foot cool and dry, certain aspects of the invention could also be advantageously utilized in retaining heat within the shoe. In a particularly preferred form of the invention a multilayer assembly, comprised of a heat resistant film disposed between two layers of strobel material, is disposed between the midsole and the insole of the shoe. The heat resistant film can be, for example, a metalized Mylar film. Such a film has a reflective surface and a non-reflective surface. Where it is desired to prevent overheating of the foot, the reflective surface of the film faces toward the midsole and acts as a barrier to reduce or inhibit the transfer of heat from hot surfaces (such as asphalt) to the foot. If desired, this arrangement could also be utilized in footwear designed to retain foot heat, in which case the reflective surface of the film would be disposed to face toward the insole. As noted above, the primary focus of the invention is upon footwear designs which can reduce overheating of the foot, to thereby keep the foot cool and dry.

With the heat resistant film disposed in the strobel material, the durability of the film is enhanced, since there is little risk of delamination, and the Mylar film is protected by the surrounding strobel material. Further, the positioning of the multilayer strobel and Mylar film layer beneath the insole is additionally advantageous in accordance with the invention, since a ventilation system is incorporated in the insole design. Thus, the multilayer strobel/Mylar assembly not only reduces the heat transfer from a hot surface to the foot, but also, the performance of the ventilation system is enhanced since the air in the ventilation system is also protected from the heat of the hot surface. Other advantageous aspects of the invention are disclosed in further detail hereinafter.

BRIEF DESCRIPTION OF THE DRAWINGS

A more complete understanding of the invention the advantages associated with the invention will become further apparent from the detailed description which follows, particularly when considered in conjunction with the drawings in which.

DESCRIPTION OF THE PREFERRED EMBODIMENTS

Figure 1:
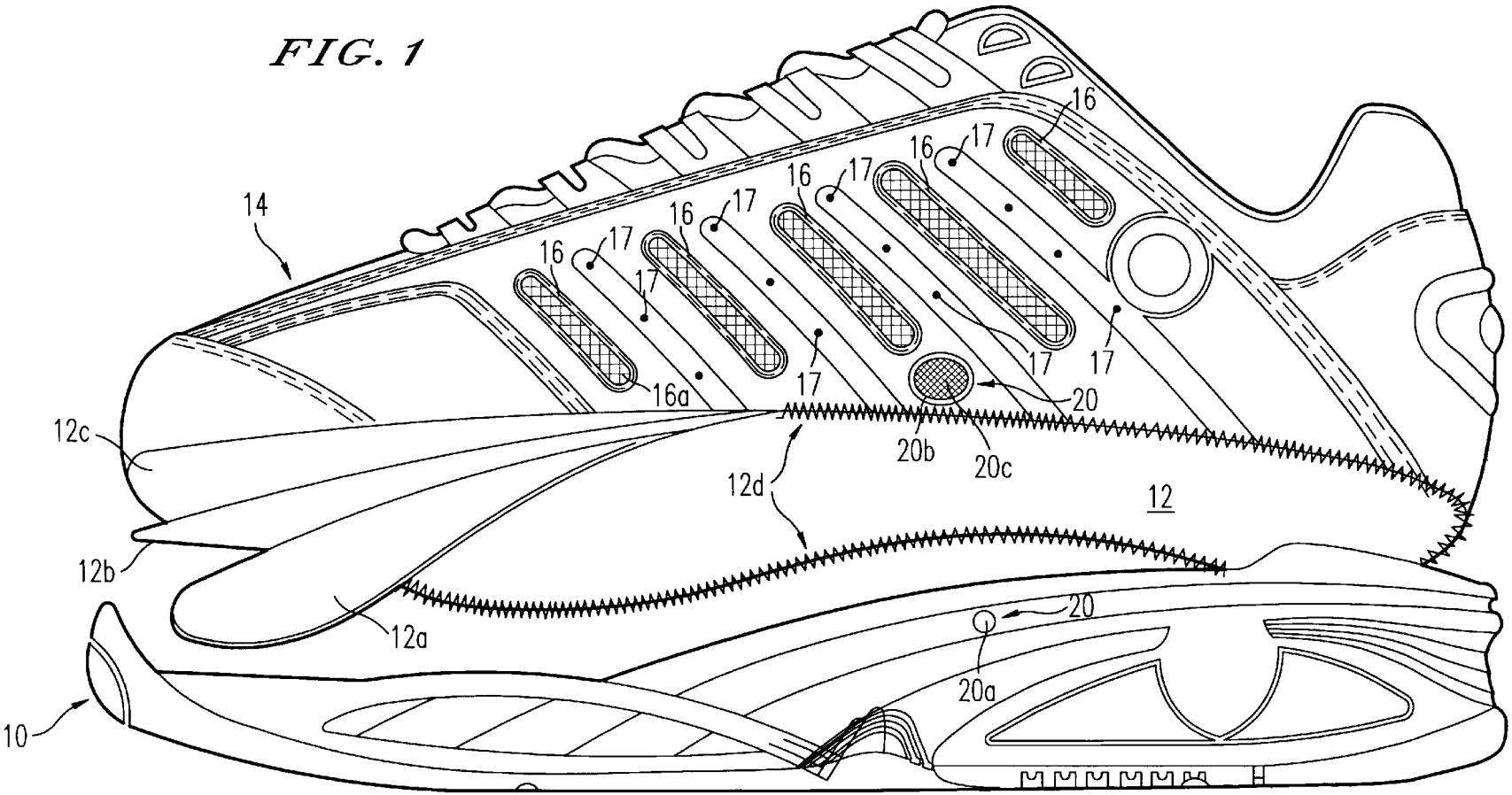
FIG. 1 is a side exploded view of a shoe according to the invention.

Referring now to the drawings, FIG. 1 is a side exploded view of a shoe in accordance with the present invention. The shoe is particularly advantageous from a standpoint of dissipating heat from the shoe and in preventing heat from hot surfaces, as can be encountered in tennis or running, from overheating the foot. The shoe includes a sole/midsole assembly represented at 10, above which an advantageous multilayer assembly 12 is provided. The sole/midsole assembly 10 can have various forms depending upon the shoe's usage and/or the wearer's preferences. Thus, the sole/midsole assembly 10 can be of various designs which provide the cushioning and support functions the athlete desires for a particular sporting activity. In accordance with the invention, the multilayer assembly 12 preferably includes a heat resistant layer or film 12*b*. This heat resistant layer serves to inhibit the transfer of heat from, e.g., hot asphalt surfaces, to the foot. In a presently preferred form, the layer 12*b* is a polymeric film which has a reflective or shiny surface and a non-reflective or non-shiny surface. For example, the heat resistant layer can be a metalized Mylar material (polyethylene terepthalate), which is sandwiched between two layers 12*a*, 12*c* of material such as strobel material or strobel board. Such Mylar materials are also known as aluminized Mylar or chrome Mylar. Although the material of layers 12*a* and 12*c* is often referred to as strobel "board," it typically is a pliable material, and can include a non-woven or woven fiber material.

As shown in FIG. 1, the Mylar 12*b* is sandwiched between a first layer 12*a* of strobel material and a second layer 12*c* of strobel material. This strobel sandwich is strobel stitched to the upper 14, with the strobel stitching represented at 12*d* in FIG. 1. As noted above, the Mylar material is preferably a metalized Mylar, which typically includes a reflective or "shiny" side and a non-reflective or "non-shiny" side. Where it is desirable to prevent excessive heat to the foot, the Mylar sheet is disposed such that the shiny or reflective side faces down. With this arrangement, the Mylar film acts as a barrier to reduce or inhibit the transfer of heat from a hot surface, such as a tennis court of asphalt surface, to the foot. If, however, it is desired to retain heat, the layer 12*b* is disposed such that the shiny or reflective surface faces upwardly, toward the insole.

In accordance with a particularly preferred form of the invention, the shoe prevents excessive heating of the foot, and the shiny or reflective surface of the layer 12*b* faces down, toward the midsole, while the non-shiny or non-reflective surface faces up, toward the insole. Since the Mylar film is extremely thin, it will not detract from the performance of the shoe from a cushioning/support standpoint. In fact, the Mylar film can be quite thin, such that it is barely visible between the layers of strobel material when the multilayer assembly 12 is viewed in cross-section. The heat resistant film adheres well to fabrics such as strobel board. Further, since the heat resistant film is sandwiched within the strobel material, the durability of the Mylar film essentially becomes the same as that of the strobel material. Thus, problems associated with delamination or deterioration of the Mylar film are avoided with the arrangement of the invention. As noted earlier, if the shoe is to be utilized under conditions in which it is desired to retain foot heat, the same multilayer assembly 12 can be used, with the heat resistant film disposed such that the reflective or shiny side faces upwardly toward the upper.

In the arrangement of FIG. 1, additional venting features are provided to further assist in modulating the foot temperature under potentially hot conditions. In combination with the use of a heat resistant film, such as metalized Mylar having the shiny or reflective side down, the venting features further assist in keeping the foot cool and dry. The venting features include a series of openings 16, 17 disposed in the upper to allow the foot to breathe through the openings. If desired, these openings can be covered (preferably from the interior of the shoe) utilizing a mesh/screen material, such as a fine wire or nylon mesh material. This mesh material allows the foot to breathe through the openings while also providing protection to the foot and preventing debris from entering into the shoe through the openings. The mesh material can also assist in maintaining the structural integrity of the upper despite the presence of the openings. The openings extending through the upper can include elongated slot openings as shown at 16 and/or a plurality of circular openings or perforations as shown at 17. Of course, openings of other sizes and shapes could also be utilized. These openings provide ventilation for the interior of the shoe through the upper of the shoe and to locations in the upper portion of the foot, i.e., above the multilayer assembly and above the shoe insole.

In addition to the vent openings 16, 17, a vent opening 20 is provided for ventilation of the shoe in the region above the multilayer assembly 12 and below the insole. Details of an insole which can advantageously cooperate with vent openings 20 are discussed hereinafter. Preferably, vent openings 20 are provided on both the lateral and the medial sides of the shoe. In the arrangement shown in FIG. 1, when the shoe is assembled, a portion of the upper is received within the midsole, such that an aperture 20*a* extending through the midsole aligns with the aperture 20*b* extending through the upper, to form the vent opening 20. As with the openings or apertures 16, 17 discussed above, the vent opening 20 can also be covered with a mesh/screen material 20*c*.

As noted above, the vent openings 20 communicate with the interior of the shoe at a location between the multilayer assembly 12 and the insole. Such an arrangement can be advantageous in a number of respects. First, as noted above, the multilayer assembly 12 reduces the amount of heat which can pass from a hot surface to the wearer's foot. Second, heat can be removed from the wearer's foot utilizing the vent openings 20, as well as vent openings 16, 17. Further, the ventilation through the opening 20 (and utilizing the ventilation system provided in the insole described hereinafter) is also more effective in view of the fact that the heat resistant film of the multilayer assembly 12 is disposed beneath the insole assembly so that heat transfer from a hot surface to air within the ventilation system is also inhibited. Thus, the multilayer assembly 12 can assist in reducing heat transfer from a hot surface to the foot, and also in reducing heat transfer from the hot surface to the air of the ventilation system to thereby enhance the effectiveness of the ventilation system.

Figure 2:
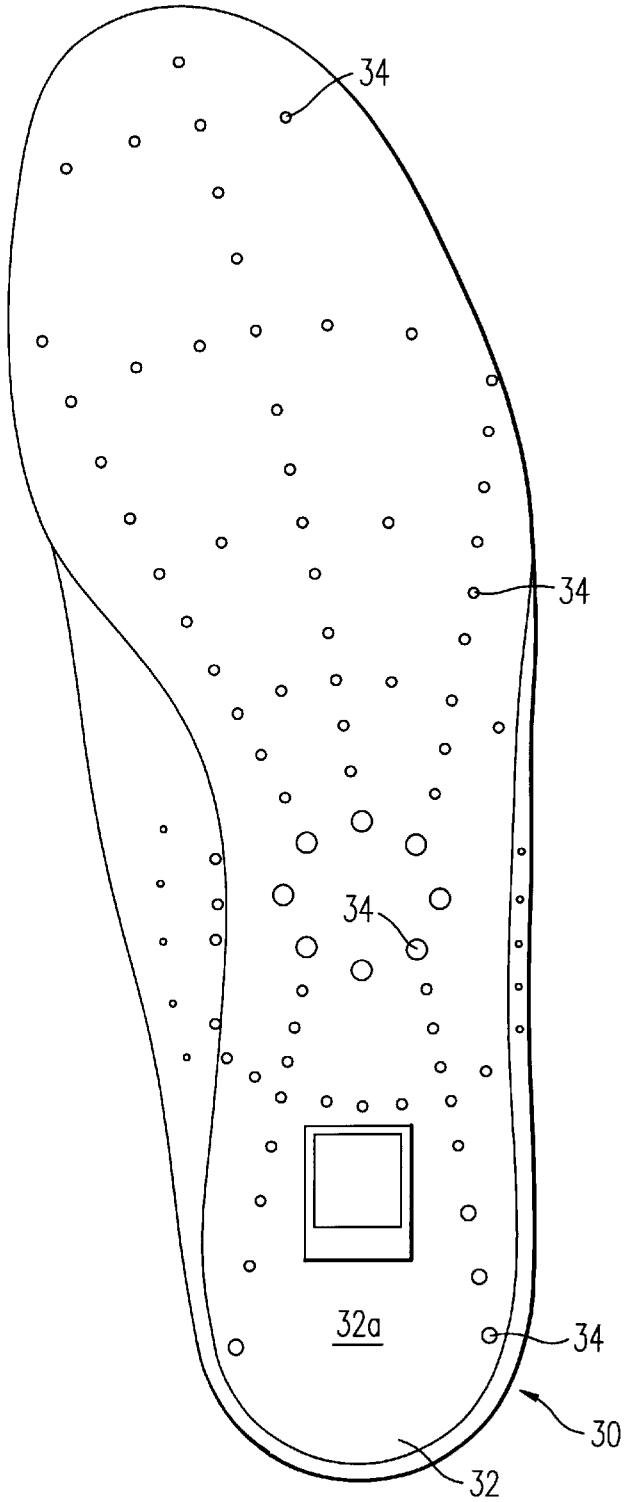
FIG. 2 is a top view of a right foot insole according to the invention.
Figure 3:
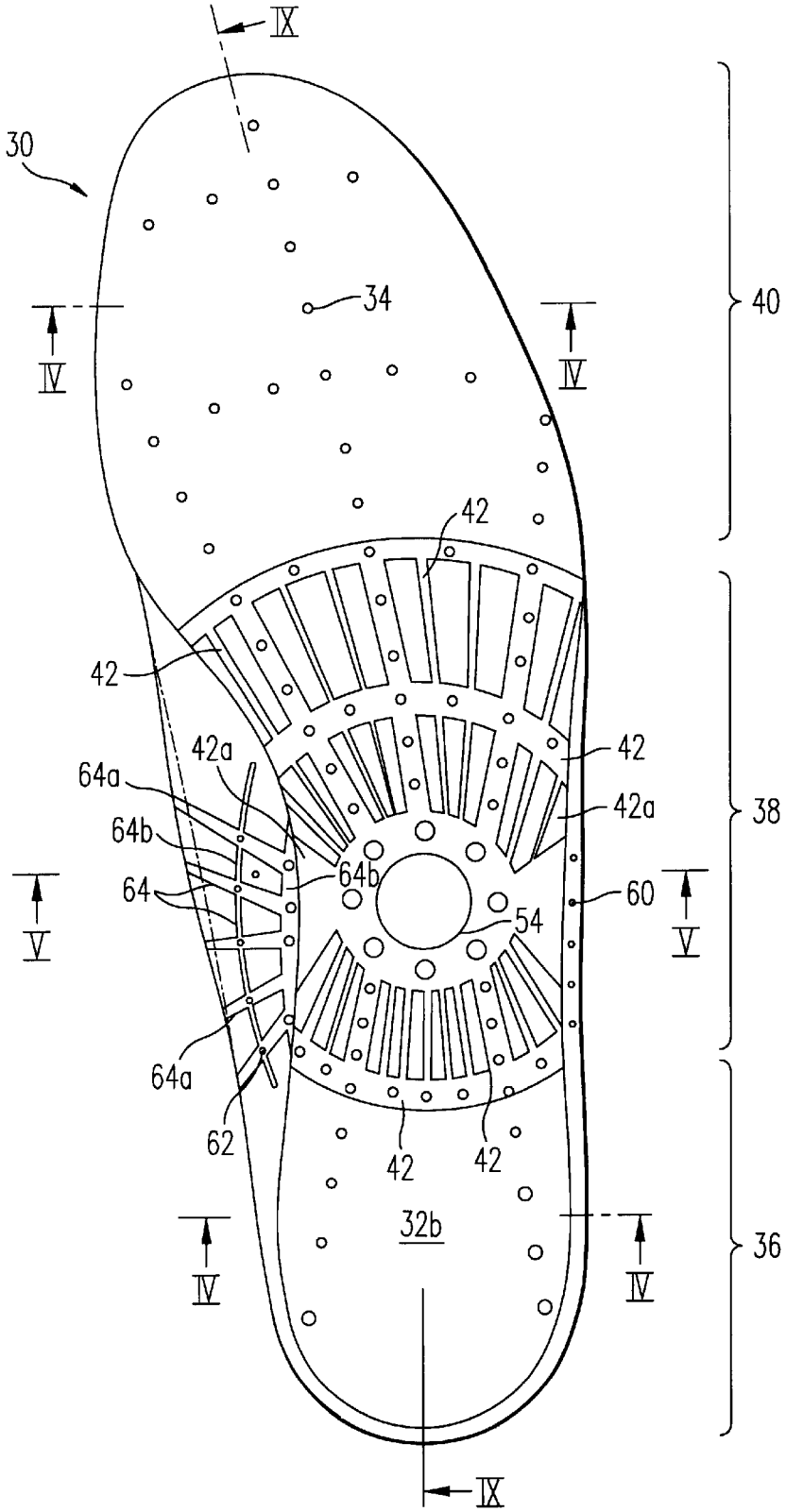
FIG. 3 is a bottom view of a left foot insole of the invention.

FIGS. 2 and 3 are, respectively, top and bottom views of an insole in accordance with the present invention. (FIG. 2 corresponds to a top view of a right foot insole, while FIG. 3 corresponds to a bottom view of a left insole.) The insole (sometimes also referred to as a sock liner) is removable in a presently preferred form of the invention. Alternately, the insole can be fastened within the shoe by various expedients or combinations of expedients, including adhesive bonding or stitching. The insole 30 is disposed above the multilayer assembly 12 and inside of the upper 14.

As shown in FIGS. 2 and 3, the insole 30 includes a bottom support 32, which supports the wearer's foot. This bottom support 32 includes a top surface 32*a*, a bottom surface 32*b*, and a plurality of apertures 34 extending through the insole from the top surface to the bottom surface. As shown in FIG. 3, the insole includes a heel region 36, a central region 38, and a forefoot region 40. The apertures 34 are preferably, but need not be, provided in each of these regions. In the central region 38, a plurality of channels are additionally formed in the bottom surface 32*b* of the bottom support 32 of the insole. These channels 42 assist in the dissipation of air/heat through the apertures 34 and to the exterior of the shoe, since the channels provide communication paths or passageways from the apertures 34 to the vent openings 20. In accordance with the present invention, it is preferable to provide the channels 42 in the central region 38 of the insole, since the central region is typically that which requires the most heat dissipation. Moreover, if a contoured/channeling structure is provided in the heel or forefoot regions of the foot, such channels could cause discomfort or otherwise interfere with the cushioning/support features of the shoe provided by the sole/midsole assembly. The channels 42 can extend in the lengthwise direction of the shoe, and can also extend transverse thereto as shown. As shown in FIG. 3, a large channel 42*a* extends across the bottom surface 32*b* of the insole in the central region 38. This large channel 42*a* communicates with the vent openings 20 which extend through the shoe (e.g., via openings 20*a*, 20*b* provided in the midsole and upper) as discussed earlier. Thus, the vent openings 20 provided in the medial and lateral sides of the shoe communicate with the channel 42*a*. The channel 42*a*, in turn, communicates with the remaining channels 42 on the bottom surface 32*b* of the insole, so that air and heat can pass along the bottom surface of the insole and through the apertures 34 to cool the bottom of the foot. The circulation of air utilizing the ventilation system is further enhanced as the wearer presses against and releases force from the insole, as the insole and the air passageways are compressed and released during movement of the wearer.

Figure 5:
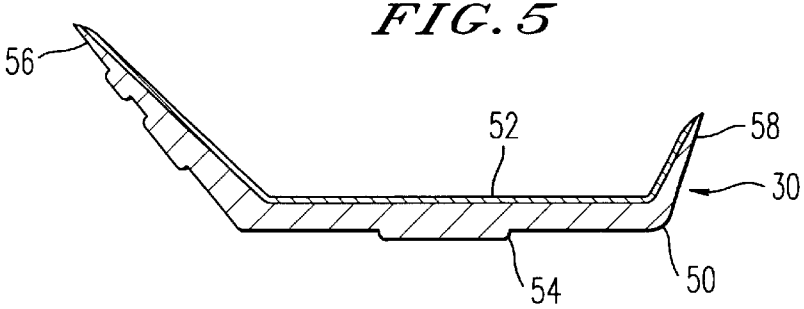
FIG. 5 is a cross-sectional view along line V—V of FIG. 3.
Figure 4:
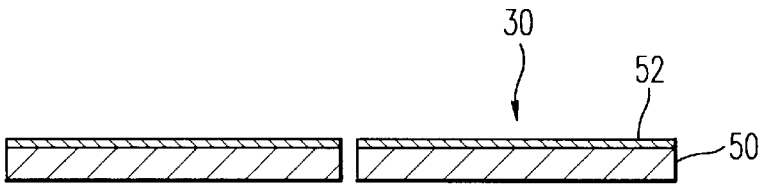
FIG. 4 is a cross-sectional view along lines IV—IV of FIG. 3.
Figure 6:
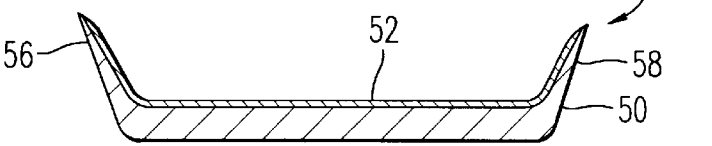
FIG. 6 is a cross-sectional view along line VI—VI of FIG. 3.
Figure 7:
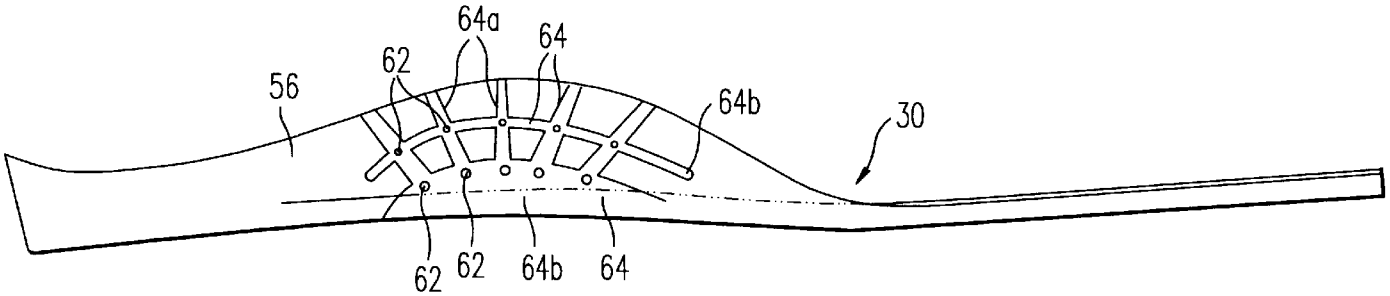
FIG. 7 is a side view of the medial side of the insole of FIG. 3.
Figure 8:
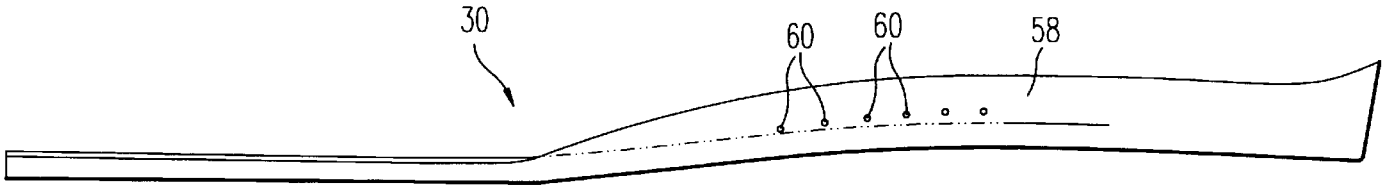
FIG. 8 is a side view of the lateral side of the insole of FIG. 3.
Figure 9:
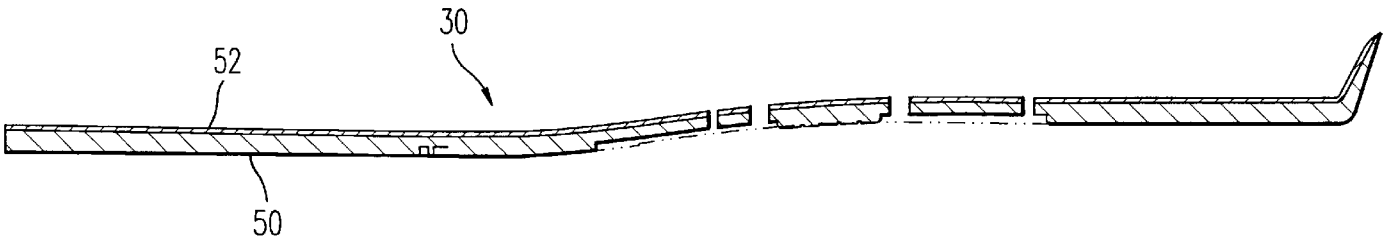
FIG. 9 is a cross-sectional view along line IX—IX of FIG. 3.

FIGS. 4–6 are cross-sectional views of the insole 30, respectively taken along lines IV—IV, V—V, and VI—VI of FIG. 3. By way of further illustration, FIG. 7 is a side view of the insole of FIGS. 2 and 3 on the medial side of the insole. FIG. 8 is a lateral side view of the insole of FIGS. 2 and 3. FIG. 9 is a cross-sectional view of the insole along section IX—IX of FIG. 3.

As shown in FIGS. 4–6, the insole 30 can include a foamable material 50, such as a foamable resin material, with a fabric 52, such as a nylon or polyester lining, disposed over the foamable resin 50. Typically, the lining 52 and foamable resin material 50 are associated with each other and thereafter are compression molded to the desired insole shape. The perforations 34 through the insole 30 can be molded or, if desired, can be formed by die cutting the insole after compression molding. As shown in FIGS. 3 and 5, a raised boss 54 can be provided within the enlarged channel region 42*a*. This raised boss 54 can provide a location to display a logo, and also can provide a flow diverter, so that air does not simply pass from the lateral vent opening to the medial vent opening 20 without aerating the remainder of the insole. In addition, this boss 54 can ensure adequate support in the central region 38 of the shoe, particularly in the region in which the enlarged channel is provided.

As shown in FIGS. 5 and 6, the insole 30 will preferably include an upwardly extending portion 56 on the medial side of the shoe and an upwardly extending portion 58 on the lateral side of the shoe. Channels and apertures can also be provided in the upwardly extending portions 56, 58 to further enhance the ability of the shoe to keep the foot cool and dry. In the embodiment shown, apertures 60 (FIGS. 3 and 8) extend through upwardly extending portion 58 the insole on the lateral side of the shoe, while the upwardly extending portion 56 on the medial side of the insole includes both apertures 62 and channels 64 (FIGS. 3 and 7). As shown in FIGS. 3 and 7, the channels 64 can include intersecting channels, with channels 64*a* extending upwardly and channels 64*b* extending in the lengthwise direction of the foot. The lowermost channel 64*b* is disposed adjacent to the enlarged channel 42*a* of the bottom surface of the insole, such that the medial vent opening 20 of the shoe can communicate with both the channels disposed on the bottom surface 32*b* of the insole as well as the channels 64 of the upwardly extending medial portion 56.

As should be apparent from the foregoing, the present invention is advantageous in a number of respects. By providing a heat resistant layer, particularly a metalized Mylar (polyethylene terepthalate), disposed between two pieces of strobel material, an effective and durable multilayer assembly is provided which can modulate the temperature of the foot. When utilized in the preferred arrangement of the present invention to keep the foot cool and dry, the multilayer assembly is effective in not only inhibiting heat from hot surfaces from transferring to the foot, but also in inhibiting the transfer of heat to the ventilation system of the invention to prevent deterioration of the performance of the ventilation system. As is also apparent, the present invention provides an advantageous ventilation system which provides for circulation of air beneath the foot, without detracting from the support/cushioning functions of the remainder of the shoe. The ventilation system is particularly advantageous in providing for flow channels or passageways in the central region of the foot at the bottom of the insole, to provide passageways for air and heat which can flow through apertures extending through the insole.

Obviously, numerous modifications and variations of the present invention are possible in light of the above teachings. It is therefore to be understood that, within the scope of the appended claims, the invention may be practiced otherwise and as specifically described herein.

What is claimed as new and desired to be secured by Letters Patent of the United States is:

1. A shoe comprising:

(a) a midsole;

(b) an upper fastened to said midsole;

(c) a multilayer assembly disposed above said midsole, said multilayer assembly comprising:

(i) a first layer of pliable material including a fabric;

(ii) a second layer of pliable material including a fabric; and (iii) a heat resistant film material sandwiched between and adhered to said first and second layers of pliable material;

wherein the first and second layers of pliable material sandwich the heat resistant film to impart a durability to the heat resistant film that is substantially the same as the first and second layers of pliable material, wherein said heat resistant film comprises metalized polyethylene terepthalate and said metalized polyethylene terepthalate includes a reflective surface which faces toward said midsole and a non-reflective surface which faces toward said upper, the shoe further including:

(d) a ventilation system which allows for the transfer of air from locations beneath a wearer's foot, said ventilation system including:

(i) an insole disposed above said multilayer assembly such that said multilayer assembly is disposed between said insole and said midsole, said insole having a bottom support upon which a wearer's foot is supported, said bottom support having top and bottom surfaces;

(ii) a plurality of apertures extending through said bottom support of said insole from said top surface to said bottom surface;

(iii) at least one vent opening extending through said upper of said shoe to provide a passageway between an exterior of said shoe and an interior of said shoe;

(iv) a plurality of channels disposed on said bottom surface of said insole, wherein said channels provide a passageway between at least some of said plurality of apertures and said at least one vent opening.

2. A shoe as recited in claim 1, wherein said multilayer assembly is stitched to said upper.

3. A shoe as recited in claim 1, wherein said at least one vent opening includes a first vent opening extending through a lateral side of said shoe and a second vent opening extending through a medial side of said shoe.

4. A shoe as recited in claim 3, wherein said first and second vent openings each include a first aperture extending through said upper and a second aperture extending through said midsole, wherein said second aperture is aligned with said first aperture.

5. A shoe as recited in claim 4, further including a mesh material extending across said first and second vent openings.

6. A shoe as recited in claim 1, wherein said plurality of apertures extending through said bottom support of said insole include:

(i) a first plurality of apertures in a heel portion of said insole;

(ii) a second plurality of apertures disposed in a central portion of said insole; and (iii) a third plurality of apertures disposed in a forefoot portion of said insole;

wherein said plurality of channels are disposed in said central portion of said insole.

7. A shoe as recited in claim 1, wherein said insole includes a molded foam material and a lining disposed on said molded foam material, said insole further including:

(i) a first upwardly extending portion disposed on a medial side of said insole;

(ii) a second upwardly extending portion on a lateral side of said insole; and (iii) at least one of a plurality of apertures and a plurality of channels disposed in said first upwardly extending portion.

8. A shoe comprising:

(a) a midsole;

(b) an upper fastened to said midsole;

(c) a multilayer assembly disposed above said midsole, said multilayer assembly comprising:

(i) a first layer of pliable material including a fabric;

(ii) a second layer of pliable material including a fabric; and (iii) a heat resistant film material adhered to and disposed between said first and second layers of pliable material;

wherein the first and second layers of pliable material sandwich the heat resistant film to impart a durability to the heat resistant film that is substantially the same as the first and second layers of pliable material;

(d) an insole, wherein said multilayer assembly is disposed between said insole and said midsole, and wherein said insole includes a molded foam material and a lining disposed on said molded foam material, said insole further including:

(i) a bottom support upon which a wearer's foot is supported, said bottom support including a heel region, a central region and a forefoot region;

(ii) a first upwardly extending portion disposed on a medial side of said insole;

(iii) a second upwardly extending portion on a lateral side of said insole;

(iv) a plurality of apertures extending through said bottom support, said plurality of apertures including apertures in each of said heel, central and forefoot regions;

(v) a plurality of channels disposed on a bottom surface of said bottom support; and at least one of a plurality of apertures and a plurality of channels disposed in said first upwardly extending portion;

wherein at least some of the apertures disposed in said central region are disposed in and extend from said plurality of channels disposed on said bottom surface, and wherein said first upwardly extending portion includes a plurality of channels and a plurality of apertures, and further wherein at least one of said plurality of channels of said first upwardly extending portion is in communication with said plurality of channels disposed on the bottom surface of said bottom support, and wherein said shoe includes at least one vent opening disposed on a medial side of said shoe, said at least one vent opening extending through said upper and said midsole, and wherein said at least one vent opening is in communication with said plurality of channels disposed on the bottom surface of said bottom support.

9. A shoe as recited in claim 8, wherein said second upwardly extending portion includes at least one of a plurality of apertures and a plurality of channels, and wherein said shoe further includes at least one vent opening on a lateral side of said shoe which is in communication with said plurality of channels on said bottom surface of said bottom support.

10. A shoe as recited in claim 8, wherein said multilayer assembly is stitched to said upper.

11. A shoe comprising:

(a) an upper;

(b) a midsole;

(c) an insole disposed above said midsole, said insole having:

(i) a bottom support upon which a wearer's foot is supported, said bottom support having top and bottom surfaces, a heel region, a central region and a forefoot region;

(ii) a plurality of channels disposed on said bottom surface of said bottom support wherein said channels are disposed in the central region of said bottom support and extend from a first end of said central region to a second end of said central region, and further wherein said plurality of channels are confined to said central region and do not extend into said heel region or said forefoot region, said plurality of channels including a large channel extending from a lateral side of said insole to a medial side of said insole, said plurality of channels further including a first plurality of smaller channels extending from said large channel and toward the heel region, wherein said first plurality of smaller channels each have widths which are smaller than a width of said large channel, wherein said plurality of channels further includes a second plurality of smaller channels extending from said large channel and toward the forefoot region, and wherein said second plurality of smaller channels each have widths which are smaller than the width of said large channel; and (iii) a plurality of apertures extending through said insole from said top surface to said bottom surface in said central region;

(d) a multilayer assembly stitched to said upper, wherein said multilayer assembly is disposed between said insole and said midsole, wherein said insole is disposed above said multilayer assembly with portions of said insole spaced from said multilayer assembly to provide a space to allow movement of air through said plurality of channels, said multilayer assembly including:

(i) a first layer of pliable material;

(ii) a second layer of pliable material; and (iii) a heat resistant film disposed between said layer and said second layer; and (e) at least one vent opening extending through one of a lateral side and a medial side of said shoe, said at least one vent opening extending through said upper and into communication with the space between said upper and said multilayer assembly.

12. A shoe as recited in claim 11, wherein said heat resistant film is a metalized polyethylene terepthalate.

13. A shoe as recited in claim 11, wherein said insole includes a first upwardly extending portion which extends from said bottom support, said first upwardly extending portion including a plurality of channels and a plurality of apertures extending through said insole.

14. A shoe as recited in claim 13, wherein said plurality of channels of said first upwardly extending portion are in communication with said vent opening.

15. A shoe as recited in claim 14, further including a plurality of apertures extending through said heel region of said midsole and a plurality of apertures extending through said forefoot region of said midsole.

16. A shoe as recited in claim 15, wherein said insole further includes a second upwardly extending portion on a lateral side of said shoe, said second upwardly extending portion including a plurality of apertures extending through said insole.

17. A shoe as recited in claim 11, wherein said at least one vent opening includes a first vent opening which extends through said upper and into said shoe at a location above said bottom support of said insole, and a second vent opening extending through said upper and into said shoe at a location below said insole.

18. A shoe as recited in claim 11, wherein said at least one vent opening includes a first vent opening extending through a lateral side of said shoe and a second vent opening extending through a medial side of said shoe.

19. A shoe as recited in claim 11, wherein said at least one vent opening extends through both said midsole and said upper.

20. A shoe as recited in claim 11, wherein said first and second layers are fabric layers, and wherein said heat resistant film is sandwiched between and adhered to said first and second layers.

21. An athletic shoe comprising:

(a) an midsole;

(b) an upper fastened to said midsole;

(c) a pliable multilayer assembly disposed above said midsole, said multilayer assembly comprising:

(i) a first layer of pliable material including a fabric;

(ii) a second layer of pliable material including a fabric;

(iii) a heat resistant film adhered to and disposed between said first fabric layer and second fabric layer;

wherein the multilayer assembly is fastened to said upper; and (d) an insole disposed above said multilayer assembly, wherein portions of said insole are spaced from said multilayer assembly to provide a spacing between the multilayer assembly and the insole, and wherein a ventilation system is provided in the spacing between said multilayer assembly and said insole, and wherein said ventilation system further includes at least one vent opening extending through at least one of said upper and said midsole, said at least one vent opening extending to said spacing to vent said spacing to outside of said shoe.

22. An athletic shoe as recited in claim 21, wherein said pliable multilayer assembly is stitched to said upper.

23. An athletic shoe as recited in claim 21, wherein said at least one vent opening extends through both said upper and said midsole.

24. An athletic shoe as recited in claim 23, wherein said heat resistant film includes a reflective surface which faces toward said midsole and a non-reflective surface which faces toward said insole.

25. An athletic shoe as recited in claim 21, wherein said heat resistant film includes a reflective surface which faces toward said midsole and a non-reflective surface which faces toward said insole.

26. An athletic shoe as recited in claim 21, wherein said ventilation system comprises:

(a) a plurality of channels disposed on a bottom surface of said insole, said plurality of channels including:

(i) a large channel in a central region of said insole between heel and forefoot regions of said insole, said large channel extending from a lateral side to a medial side of said insole;

(ii) a first plurality of smaller channels having a width which is smaller than a width of said large channel, said first plurality of smaller channels extending from said large channel and toward said heel region; and (iii) a second plurality of smaller channels having a width which is smaller than a width of said large channel, said second plurality of smaller channels extending from said large channel and toward said forefoot region;

(b) a first vent opening extending through said midsole on a lateral side of said athletic shoe, said first vent opening communicating with said large channel to provide a first passageway from said large channel to an exterior of the athletic shoe; and (c) a second vent opening extending through said midsole on a medial side of said athletic shoe, said second vent opening communicating with said large channel to provide a second passageway from said large channel to the exterior of the athletic shoe.

27. An athletic shoe as recited in claim 26, further including a raised boss disposed in said large channel.

28. An athletic shoe as recited in claim 27, wherein said pliable multilayer assembly is stitched to said upper.

29. A shoe comprising:

(a) an upper including a lateral side having a lateral vent opening extending therethrough and a medial side having a medial vent opening extending therethrough;

(b) an insole comprising:

(i) a bottom support upon which a wearer's foot is supported, said bottom support having top and bottom surfaces, a heel region, a central region and a forefoot region;

(ii) a boss disposed on said bottom surface and having a raised portion which at least partially delimits curved channels which are in communication with the lateral vent opening and the medial vent opening;

(iii) at least a first channel traversing a first end of the central region and at least a second channel traversing a second end of the central region;

(iv) a plurality of radial channels disposed on said bottom surface of said bottom support, each of said plurality of radial channels extending from one of said curved channels and toward one of said first end of said central region and said second end of said central region, and wherein air is diverted from said curved channels to said plurality of radial channels to reduce air flowing from the lateral vent opening to the medial vent opening; and (v) a plurality of apertures extending through said insole from said top surface to said bottom surface in said central region.

30. A shoe as recited in claim 29, further including a multilayer assembly comprising:

(i) a first layer of pliable material including a fabric;

(ii) a second layer of pliable material including a fabric; and (iii) a heat resistant film material including a polymeric film, said heat resistant film being adhered to and sandwiched between said first and second layers of pliable material.

31. A shoe as recited in claim 30, wherein the polymeric film includes polyethylene terepthalate.

32. A shoe as recited in claim 30, wherein said multilayer assembly is disposed beneath said insole.

33. A shoe as recited in claim 32, wherein said heat resistant film includes a reflective surface which faces downwardly.

* * * * *